US010648758B2

(12) United States Patent
Grix et al.

(10) Patent No.: US 10,648,758 B2
(45) Date of Patent: May 12, 2020

(54) FLARING TOOL FOR HANDGUN MAGAZINE WELLS

(71) Applicant: GR IX SOLUTIONS LLC, Whitmore Lake, MI (US)

(72) Inventors: Paul Grix, Whitmore Lake, MI (US); Heidi Grix, Whitmore Lake, MI (US); Claudia Rast, Whitmore Lake, MI (US)

(73) Assignee: GR IX Solutions LLC, Whitmore Lake, MI (US)

( * ) Notice: Subject to any disclaimer, the term of this patent is extended or adjusted under 35 U.S.C. 154(b) by 314 days.

(21) Appl. No.: 15/673,337

(22) Filed: Aug. 9, 2017

(65) Prior Publication Data

US 2019/0049209 A1 Feb. 14, 2019

(51) Int. Cl.

| | |
|---|---|
| ***F41C 3/06*** | (2006.01) |
| ***F41A 35/00*** | (2006.01) |
| *F41A 9/65* | (2006.01) |
| *F41A 23/18* | (2006.01) |
| *F41A 23/10* | (2006.01) |
| *F41A 17/38* | (2006.01) |
| *F41A 23/12* | (2006.01) |

(52) U.S. Cl.

CPC ..... *F41A 35/00* (2013.01); *F41A 9/65* (2013.01); *F41A 17/38* (2013.01); *F41A 23/10* (2013.01); *F41A 23/12* (2013.01); *F41A 23/18* (2013.01)

(58) Field of Classification Search

CPC .. F41A 35/00; F41A 9/65; F41A 17/38; F41A 23/18; F41A 23/12; F41A 23/10

USPC ..... 72/370.1

See application file for complete search history.

(56) References Cited

U.S. PATENT DOCUMENTS

| | | | | |
|---|---|---|---|---|
| 5,584,136 | A | 12/1996 | Boland et al. | |
| 8,006,423 | B1 | 8/2011 | Alzamora et al. | |
| 9,429,377 | B2 | 8/2016 | Alkhalaileh et al. | |
| 10,415,922 | B2 * | 9/2019 | Reik | F41A 23/18 |
| 2011/0067226 | A1 * | 3/2011 | Westbrook | B23B 47/28 29/559 |
| 2013/0139426 | A1 * | 6/2013 | Baxley | F41C 23/10 42/71.02 |
| 2017/0153084 | A1 * | 6/2017 | Tarazi | F41C 23/12 |
| 2018/0112947 | A1 * | 4/2018 | Reik | F41A 23/18 |
| 2019/0049209 | A1 * | 2/2019 | Grix | F41A 35/00 |
| 2019/0226779 | A1 * | 7/2019 | DiChario | F41A 17/38 |

FOREIGN PATENT DOCUMENTS

| | | |
|---|---|---|
| EP | 2805123 | 11/2014 |
| WO | 2016123009 | 8/2016 |

* cited by examiner

*Primary Examiner* — David B Jones

(74) *Attorney, Agent, or Firm* — Burris Law, PLLC

(57) ABSTRACT

A tool for use in flaring a handgun magazine well includes a housing and an insert. The housing defines at least one contoured peripheral surface. The insert is engaged with the housing and defines at least one magazine release notch. The contoured peripheral surface is configured to shape a corresponding inner surface of the magazine well. The magazine release notch is configured to engage a magazine release mechanism within the magazine well.

23 Claims, 12 Drawing Sheets

FLARING TOOL FOR HANDGUN MAGAZINE WELLS

FIELD

The present disclosure relates generally to handgun magazine wells, and more particularly to devices and methods for improving the speed of loading a magazine into a magazine well.

BACKGROUND

The statements in this section merely provide background information related to the present disclosure and may not constitute prior art.

In competitive handgun shooting, a shooter may need to reload the handgun several times by pressing a magazine release, dropping an empty magazine from the magazine well of the grip, and inserting and locking a loaded magazine back into the magazine well. Generally, the magazine has an outer profile that is complementary to inner surfaces of the magazine well such that the magazine can fit snugly into the magazine well. The complementary profiles of the magazine and the magazine well can may make reloading the handgun difficult, particularly when the shooter is under pressure during competition. In competitive handgun shooting, the handgun should be reloaded as quickly as possible.

Known devices that help to improve the speed of loading magazines include the "adaptive magwell" provided by Lancer, or the variety of "magwells" provided by Speed Shooters, International. Generally, these devices are separate components that are attached to the end portion of a magazine well and increase the size of the opening of the magazine well, thus increasing the speed with which the firearm can be reloaded. These devices, however, add increased costs to the firearm and are often not allowed in competitive shooting.

SUMMARY

In one form of the present disclosure, a tool for use in flaring a handgun magazine well includes a housing and an insert. The housing defines at least one contoured peripheral surface, and the insert is engaged with the housing and defines at least one magazine release notch. The contoured peripheral surface is configured to shape a corresponding inner surface of the magazine well. The magazine release notch is configured to engage a magazine release mechanism within the magazine well. In one form, the housing and the insert are separate components, however, in another form, they are a single integrated piece. The housing in one form defines a series of contiguously arranged contoured peripheral surfaces, which may be angled. The angled surfaces define an angle of approximately 45° relative to a longitudinal axis of the magazine well.

An adjustment device is operatively engaged with the insert and the housing, wherein the adjustment device is operable to move the housing relative to the insert during operation. In one form, the insert is slidably engaged within the housing and the adjustment device comprises a threaded shaft secured to the insert and extending through a bottom portion of the housing and an adjustment nut threadably engaged with the threaded shaft. The housing in one form comprises a base portion, and the adjustment nut engages the base portion to move the housing towards the magazine well. The base portion may be a separate component secured to the bottom portion of the housing. Further, a stabilizing pin is secured across the housing, wherein the insert defines a longitudinal slot, and the stabilizing pin extends through the longitudinal slot.

In still another form, at least one heating element is disposed proximate the at least one contoured peripheral surface. In another form, the insert defines a distal extension configured to abut a slide of the handgun before the at least one notch engages the magazine release mechanism. A thermal barrier may also be disposed between the insert and the housing. Further still, the at least one contoured peripheral surface may include an embossing feature.

In another form, a method of flaring the handgun magazine well is provided, which includes heating a proximal end portion of the magazine well until the material of the magazine well reaches its glass transition temperature and placing the tool as set forth above into the magazine well. The method further includes moving the insert and housing into the magazine well until the at least one contiguously arranged contoured peripheral surface abuts and plastically deforms a mating inner surface of the magazine well, holding the tool in place for a predetermined period of time, and removing the tool from the magazine well. The step of moving the insert and the housing is manual in one form, but may be automated. In one form, the distal end portion of the magazine well is heated by external source. The external source may be oil, such as vegetable oil.

In still another form, a tool for use in flaring a handgun magazine well includes a housing defining at least one contoured peripheral surface, an insert slidably engaged within the housing, and an adjustment device operatively engaged with the insert and the housing. The contoured peripheral surface is configured to shape a corresponding inner surface of the magazine well. In one variation, the insert defines an external geometry corresponding to an external geometry of a magazine configured to slide and lock within the magazine well. A method of flaring the handgun magazine well with this form of a tool is also provided that includes heating a distal end portion of the magazine well until a material of the magazine well reaches its glass transition temperature, placing the tool into the magazine well, tightening the adjustment nut until the contiguously arranged contoured peripheral surfaces abut and plastically deform mating inner surfaces of the magazine well, holding the tool in place for a predetermined period of time, and loosening the adjustment nut to remove the tool from the magazine well.

In still another form, a tool for use in flaring a handgun magazine well includes a housing, an insert slidably engaged within the housing, and an adjustment device operatively engaged with the insert and the housing. The housing defines a series of contiguously arranged contoured peripheral surfaces and a base portion. The adjustment device includes a threaded shaft secured to the insert and extending through a bottom portion of the housing, and an adjustment nut threadably engaged with the threaded shaft. The adjustment nut engages the base portion to move the housing towards the magazine well. The contoured peripheral surfaces are configured to shape corresponding inner surfaces of the magazine well.

Further areas of applicability will become apparent from the description provided herein. For example, the teachings of the present disclosure are applicable to all types of firearms or even openings that are desired to be flared/increased in size and thus are not limited to hand guns or firearms. Therefore, it should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

Corresponding reference numerals indicate corresponding parts throughout the several views of the drawings.

DETAILED DESCRIPTION

The following description is merely exemplary in nature and is not intended to limit the present disclosure, application, or uses.

Figure 1:
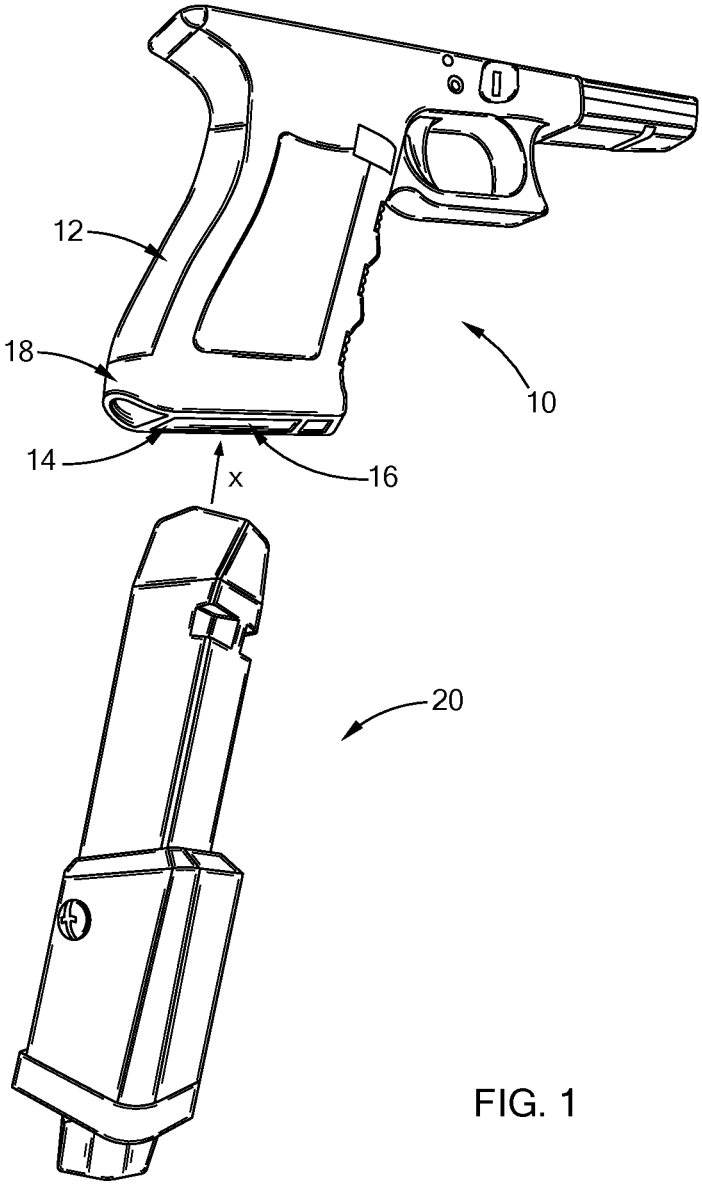
FIG. 1 is a perspective view of a handgun and a tool for flaring a magazine well of the handgun in accordance with the teachings of the present disclosure.
Figure 2:
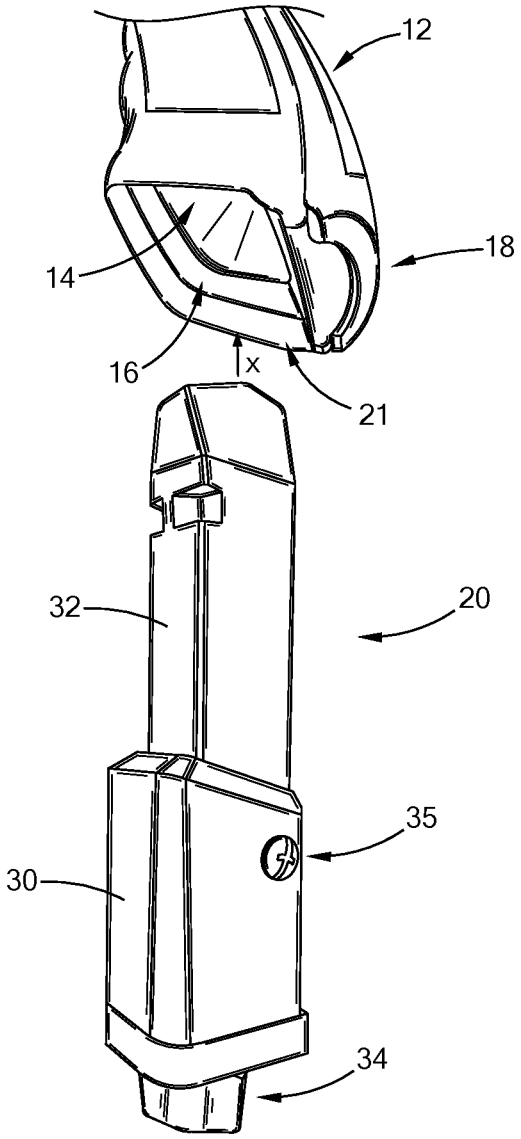
FIG. 2 is another enlarged perspective view of a handgun and a tool or flaring a magazine well of the handgun, with the magazine well flared, in accordance with the teachings of the present disclosure.

Referring to FIGS. 1 and 2, a tool for use in flaring a handgun magazine well is illustrated and generally indicated by reference numeral 20. A handgun 10 includes a grip 12 defining the magazine well 14 therein. The grip 12 includes a proximal end portion 18 defining a bottom opening 16 of the magazine well 14. As described in greater detail below, the tool 20 is used to flare or expand the bottom opening 16 of the magazine well 14 by inserting the tool 20 into the magazine well 14 along an insertion direction, which is parallel to a longitudinal direction X of the tool 20.

Figure 3A:
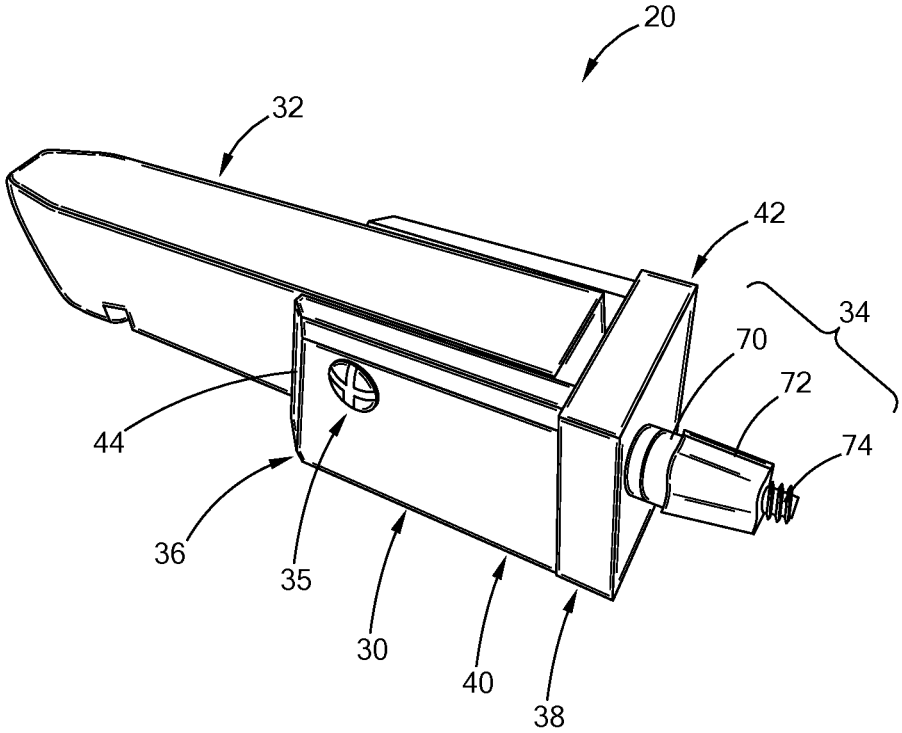
FIG. 3A is a perspective view of one form of a tool for flaring a handgun magazine well constructed in accordance with the teachings of the present disclosure.
Figure 3B:
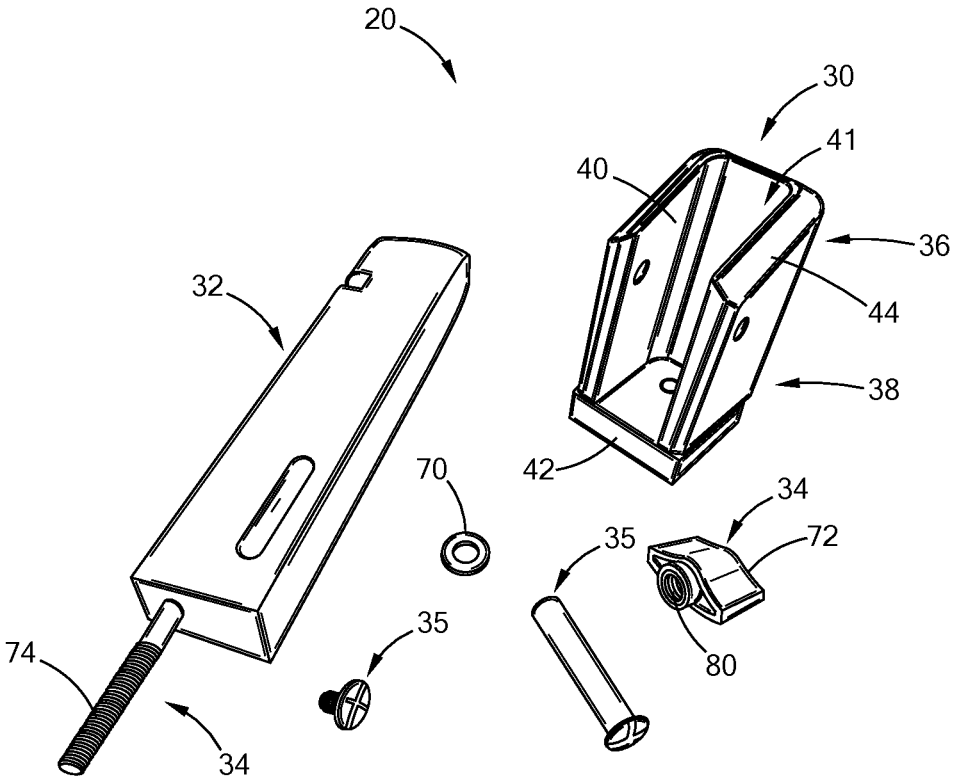
FIG. 3B is an exploded view of the tool of FIG. 3A.
Figure 4:
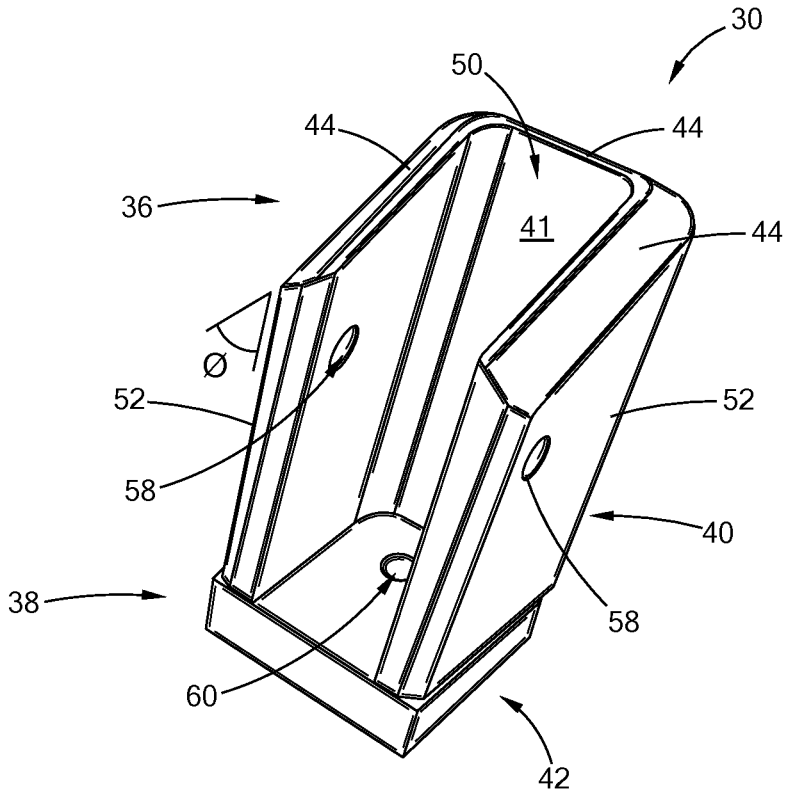
FIG. 4 is a perspective view of a housing of the tool of FIGS. 3A and 3B.
Figure 5:
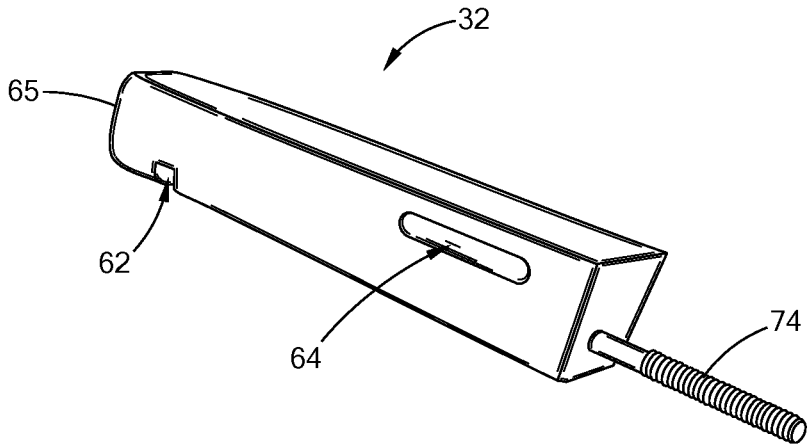
FIG. 5 is a perspective view of an insert and a threaded shaft of an adjustment device of the tool of FIGS. 3A and 3B.
Figure 6:
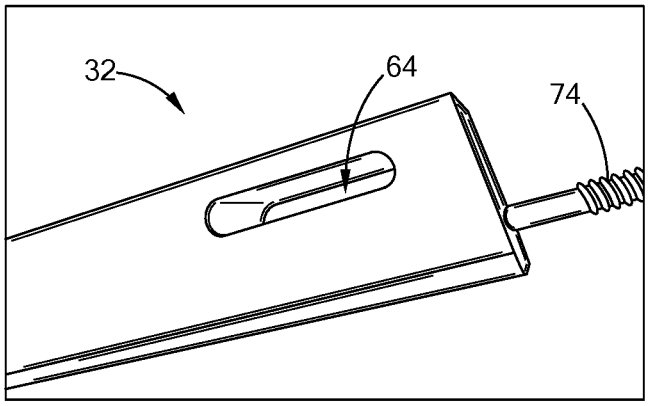
FIG. 6 is a partial perspective view of the insert and the threaded shaft of FIG. 5.
Figure 7:
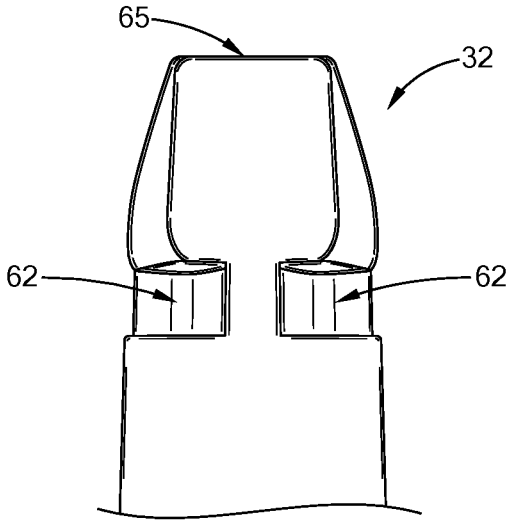
FIG. 7 is a partial top view of a distal end portion of the insert of FIG. 5, illustrating magazine release notches constructed in accordance with the teachings of the present disclosure.
Figure 8:
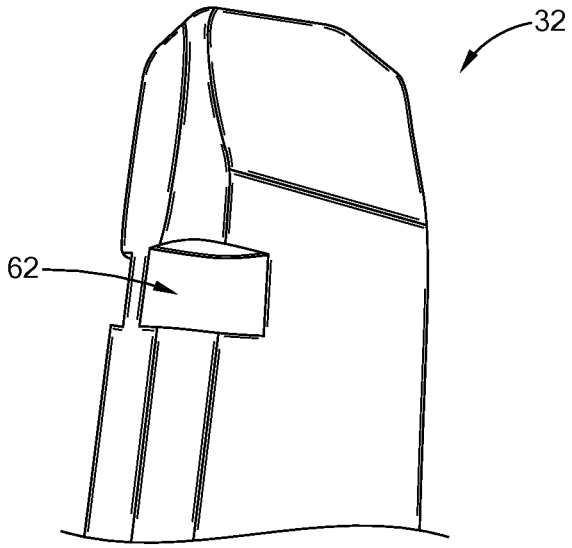
FIG. 8 is a partial perspective view of the distal end portion of the insert of FIG. 5, illustrating a magazine release notch constructed in accordance with the teachings of the present disclosure.

Referring also to FIGS. 3A and 3B and 4, the tool 20 in one form includes a housing 30, an insert 32 engaged with the housing 30, an adjustment device 34 operatively engaged with the insert 32 and the housing 30, and a stabilizing device 35. In one form, the insert 32 is slidable relative to the housing 30 along the longitudinal direction X of the tool 20.

The housing 30 defines a distal (or upper) end 36 and a proximal (or bottom) end 38 opposing the distal end 36. The distal end 36 and the proximal end 38 of the housing 30 define the longitudinal direction X of the housing 30 and the tool 20. In this form, the housing 30 includes a main body 40 and a base portion 42 attached to the main body 40 at the proximal end 38. It should be understood, however, that the housing 30 may be one piece, or in other words, the main body 40 and the base portion 42 are combined into one unitary component. In this form, the main body 40 is wood and the grain of the wood as shown is aligned with the longitudinal direction X of the tool 20, as described in greater detail below. The base portion 42 is also wood in this form, with the wood grains running perpendicular to the longitudinal direction X. It should be understood that a variety of materials may be used for the housing 30, and other components of the tool 20, and thus the illustration of wood herein should not be construed as limiting the scope of the present disclosure.

The main body 40 has a substantially U-shaped configuration and defines a receiving space 41. The main body 40 of the housing 30 defines a series of contiguously arranged contoured peripheral surfaces 44 at the distal end 36. The series of contiguously arranged contoured peripheral surfaces 44 are angled in one form, defining an angle ø of approximately 45° relative to the longitudinal direction X of the tool 10 and a longitudinal axis of the magazine well 14. The contoured peripheral surfaces 44 are configured to shape a corresponding inner surface of the magazine well 14, i.e., the inner surfaces 20 of the proximal end portion 18.

The main body 40 of the housing 30 has a front wall 50 and two opposing side walls 52 extending from opposing ends of the front wall 50. The opposing side walls 52 each define a through hole 58. The through holes 58 are aligned along a direction perpendicular to the longitudinal direction X of the tool 10 to allow the stabilizing device 35 to be inserted through the holes 58.

The base portion 42 has a plate configuration and defines a bottom hole 60 through which the adjustment device 34 is operable. The main body 40 and the base portion 42 may be formed as a single piece component or as two separate components connected together, as illustrated herein.

As shown in FIGS. 3A and 3B, the adjustment device 34 includes a washer 70 (optional), an adjustment nut 72, and a threaded shaft 74 extending through a threaded insert 80 of the adjustment nut 42 and through the bottom hole 60 of the base portion 42. The threaded shaft 74 extends through the base portion 42 and is fixedly secured to the insert 32. As such, the adjustment device 34 is operatively engaged with the insert 32 and the housing 30 and is operable to move the insert 32 relative to the housing 30. More specifically, the adjustment nut 72 engages the base portion 42 and is threadably engaged with the threaded shaft 74 to move the housing 30 towards the magazine well 14 once the insert 32 is locked into the handgun magazine well 14, which is described in greater detail below.

Referring to FIGS. 5 to 8, the insert 32 has an elongated configuration and defines an external geometry corresponding to an external geometry of a magazine configured to slide and lock within the magazine well 14. The insert 32 defines at least one magazine release notch 62. The magazine release notch 62 is configured to engage a magazine release mechanism 13 (shown in FIGS. 11A-11C) within the magazine well 14. In this form, two notches 62 are provided for both left-hand and right-hand release mechanisms within the handgun 10. The insert 32 further defines a distal extension 65 configured to abut a slide 11 (also shown in FIGS. 11A-11C) of the handgun 10 before the magazine release notch 62 of the insert 32 engages the magazine release mechanism. Therefore, in this form, the slide 11 must be removed before the tool 20 can be properly positioned in the magazine well 14 to flare the magazine well 14. The insert 32 also includes a longitudinal slot 64 that allows for translation of the insert 34 relative to the housing 30.

Figure 9:
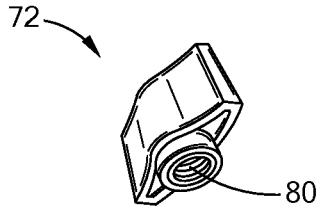
FIG. 9 is a perspective view of an adjustment nut constructed in accordance with the teachings of the present disclosure.
Figure 10:
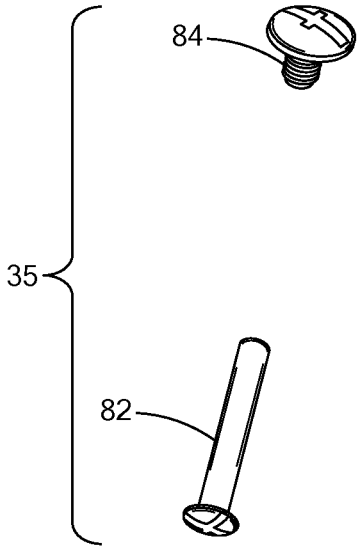
FIG. 10 is an exploded view of a stabilizing device of the tool of FIGS. 3A and 3B constructed in accordance with the teachings of the present disclosure.

Referring also to FIG. 9 and FIG. 10, the stabilizing device 35 is secured to the housing 30 for positioning and guiding the insert 32 to move relative to the housing 30 along the longitudinal direction X of the tool 20. The stabilizing device 35 includes a stabilizing pin 82 extending across the housing 30, and an end screw 84 engaging a corresponding threaded inner diameter of the stabilizing pin 82. The stabilizing pin 82 is inserted through the longitudinal slot 64 of the insert 32. Once the insert 32 is placed within receiving space 41 the housing 30, the stabilizing pin 82 and the end screw 84 are inserted into the through holes 58 of the side walls 52 of the housing 30 to slidably secure the insert 32 within the housing 30.

Figures 11A, 11B, 11C:
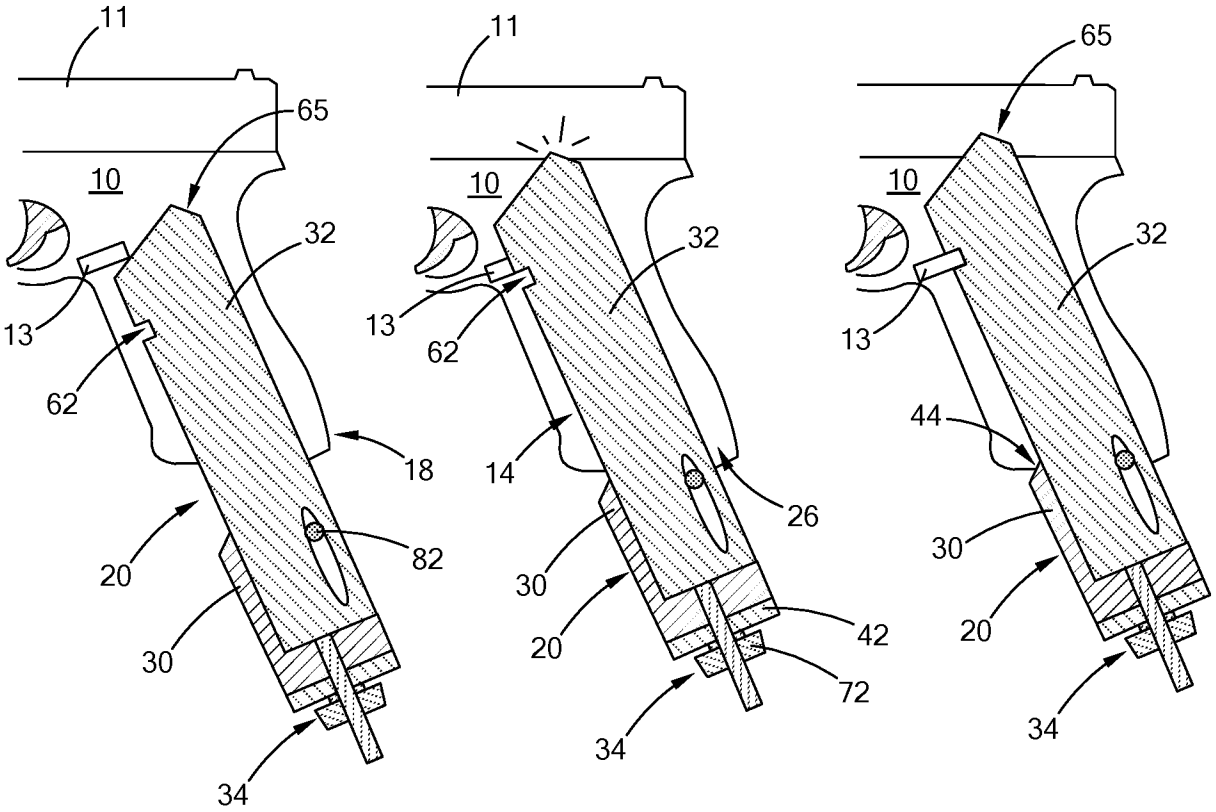
FIGS. 11A-11C illustrate a method of flaring a handgun magazine well according to the teachings of the present disclosure.

Referring now to FIGS. 11A through 11C, a method of flaring the handgun magazine well 14 according to the present disclosure starts with heating a proximal end portion 18 of the magazine well 14 until a material of the magazine well 14 reaches its glass transition temperature, or when the material begins to soften, thus allowing for plastic deformation by the contoured peripheral surfaces 44. In one form, the proximal end portion 18 of the magazine well 14 is heated by an external source, such as oil, which may be vegetable oil. With oil, the oil is heated and the proximal end portion 18 is placed into the oil for a duration long enough to heat the material of the handgun magazine well 14 past its glass transition temperature such that it is deformable while heated. (The proximal end portion 18 of the magazine well 14 includes the bottom opening 26 of the magazine well 14).

Next, while the material of the distal end portion 18 of the magazine well 14 is still soft, the insert 32 of the tool 20 is moved into the magazine well 14. The insert 32 is moved into the magazine well 14 until the notch 62 is locked into place by the magazine release mechanism 13. After the insert 32 is locked into place in the magazine well 14, the housing 30 is moved toward the proximal end portion 18 of the magazine well 14 by tightening the adjustment nut 72 until the contiguously arranged contoured peripheral surfaces 44 abut the mating inner surface 17 of the magazine well 14. The contiguously arranged contoured peripheral surfaces 44 abut and plastically deform the mating inner surface 17 of the magazine well 14 as the adjustment nut 72 is tightened. The mechanical action of the adjustment nut 72 against the base portion 42 draws the housing 30 towards the magazine well 14, while the stabilizing pin 82 traverses the longitudinal slot 64 of the insert 32.

Once a maximum amount of travel of the housing 30 is achieved, the heat source is removed, and the tool 20 is held in place for a predetermined period of time. The predetermined period of time is a function of the material of the magazine well 14 and the temperature to which the distal end portion 18 reaches. Generally, the tool 20 is held in place until the material proximate the distal end portion 18 cools and hardens, or cools below its glass transition temperature. Finally, the tool 20 is removed from the magazine well 14 by activating the magazine release mechanism 13 and pulling the tool 12 out from the magazine well 14.

In another form of the present disclosure, the housing 30 and the insert 32 are a single component and the tool 20 does not include an adjustment device. Instead, the insert 32 placed within the magazine well and the contoured peripheral surfaces 44 of the housing 30 are forced against the distal end portion 18 in order to plastically deform the inner surfaces 20. This movement may be manual or may be carried out by an automatic process such as by way of example, a ram. Further, the adjustment device may take on any number of forms in order to perform the appropriate plastic deformation of the inner surfaces 20, and thus the adjustment nut 72 and threaded shaft 74 are merely exemplary. The movement of the insert 32 and the housing 30 may be manual or automated.

Figure 12:
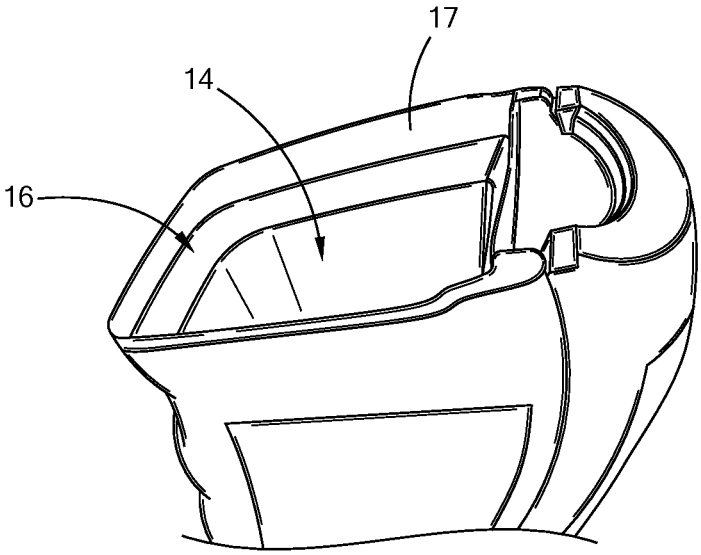
FIG. 12 is a partial perspective view of a handgun magazine well that has been flared with a tool and method according to the teachings of the present disclosure.

As shown in FIG. 12, an exemplary handgun magazine well 14 is shown, which has been flared with the tool 20 according to the teachings of the present disclosure. As shown, the bottom opening 26 includes the mating inner surfaces 17 that have been plastically deformed by the contiguously arranged contoured peripheral surfaces 44 of the housing 30.

Figure 13:
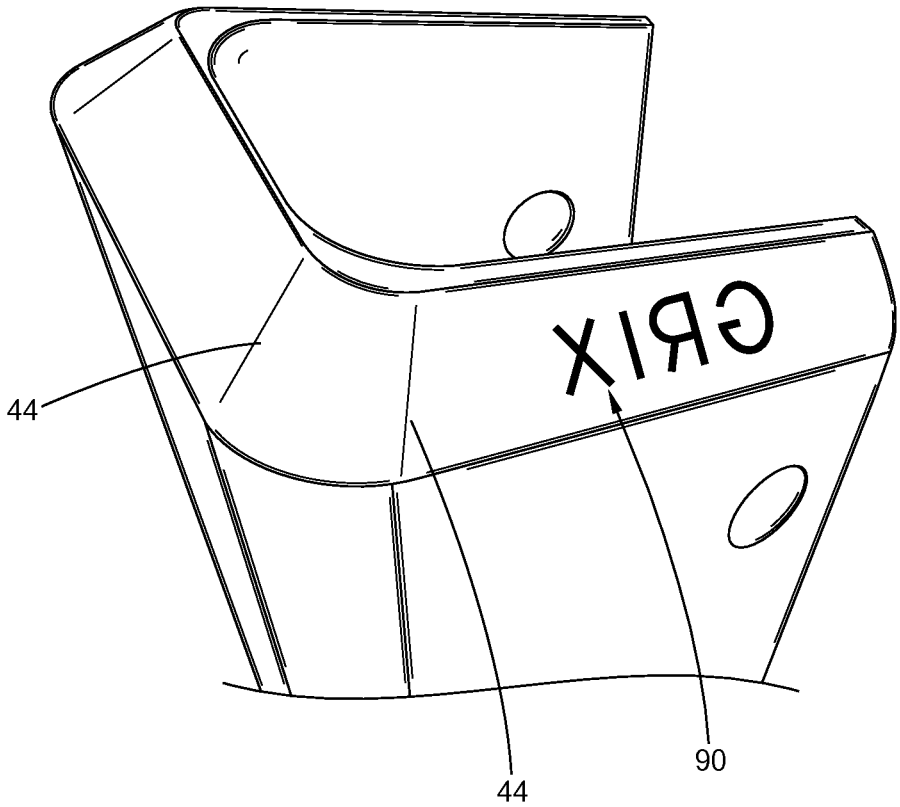
FIG. 13 is an enlarged perspective view illustrating an embossing feature according to the teachings of the present disclosure.

Referring now to FIG. 13, optionally, one of the contoured peripheral surfaces 44 of the housing 30 may include an embossing feature 90 to emboss, for example, the handgun owner's name or initials into the inner surface 20 of the magazine well 14.

Figure 14:
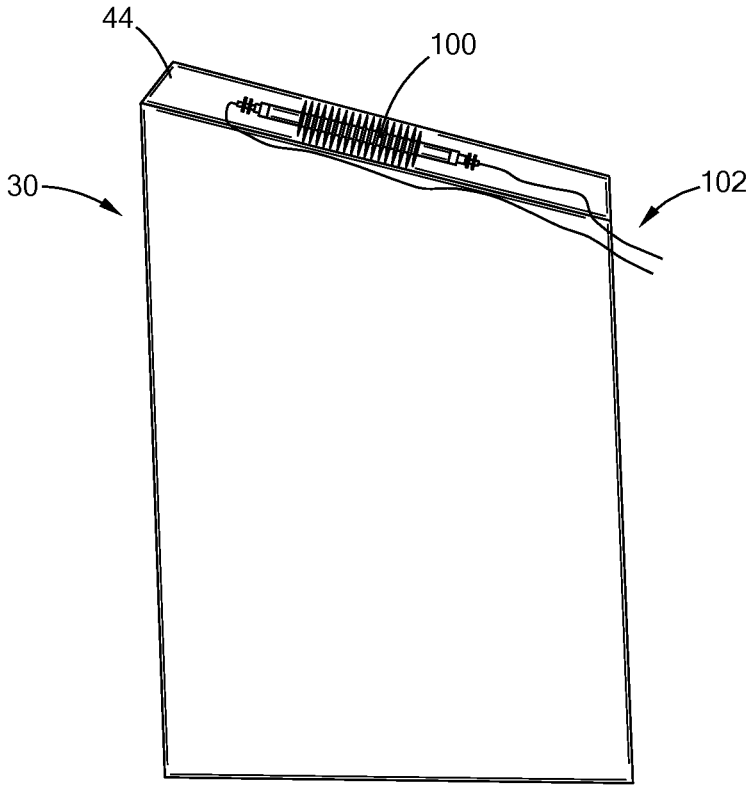
FIG. 14 is a side view of a housing having an integral heating element and constructed according to the teachings of the present disclosure.

In another form as shown in FIG. 14, at least one heating element 100 may be disposed proximate one of the contoured peripheral surfaces 44 for heating the contoured peripheral surface 44 to facilitate the flaring operation. The heating element 100 in this form is a resistive wire embedded within the housing 30, and the tool 20 includes lead wires 102 that connect the heating element 100 to a power source (not shown). The power source may be internal to the tool 20 (e.g., battery/batteries), or external (e.g. 110V wall outlet). When a heating element 100 is provided proximate the contoured peripheral surfaces 44, the tool 20 may further include a thermal barrier such as a conductive foil (not shown) disposed between the insert 32 and the housing 30 so that heat from the heating element 100 does not affect operation of the tool 20, namely, movement of the insert 32. It should be understood that any type of integral heating element 100 may be employed other than a resistive wire as shown. For example, the heating element 100 may be a thermally sprayed heater, a thin film heater, a sol-gel heater, or a foil heater, among other forms while remaining within the scope of the present disclosure.

By using the tool 20 to slightly flare the distal end portion 18 of the magazine well 14, reloading a magazine into the magazine well 14 becomes easier and more time efficient without the need to change the structure of the handgun grip. Therefore, a shooter can reduce the amount of time to reload a magazine within the handgun to gain an advantage in competitive handgun shooting.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A tool for use in flaring a handgun magazine well comprising:

a housing defining at least one contoured peripheral surface; and an insert engaged with the housing, the insert defining at least one magazine release notch, wherein the contoured peripheral surface is configured to shape a corresponding inner surface of the magazine well and the magazine release notch is configured to engage a magazine release mechanism within the magazine well.

2. The tool according to claim 1, wherein the housing and the insert are separate components.

3. The tool according to claim 1, wherein the housing defines a series of contiguously arranged contoured peripheral surfaces.

4. The tool according to claim 3, wherein the series of contiguously arranged contoured peripheral surfaces is angled.

5. The tool according to claim 4, wherein the angled surfaces define an angle of approximately 45° relative to a longitudinal axis of the magazine well.

6. The tool according to claim 1 further comprising:

an adjustment device operatively engaged with the insert and the housing, wherein the adjustment device is operable to move the housing relative to the insert.

7. The tool according to claim 6, wherein the insert is slidably engaged within the housing and the adjustment device comprises:

a threaded shaft secured to the insert and extending through a bottom portion of the housing; and an adjustment nut threadably engaged with the threaded shaft.

8. The tool according to claim 6, wherein the housing further comprises a base portion, and the adjustment nut engages the base portion to move the housing towards the magazine well.

9. The tool according to claim 7, wherein the base portion is a separate component secured to the bottom portion of the housing.

10. The tool according to claim 7 further comprising a stabilizing pin secured across the housing, wherein the insert defines a longitudinal slot, and the stabilizing pin extends through the longitudinal slot.

11. The tool according to claim 1 further comprising at least one heating element disposed proximate the at least one contoured peripheral surface.

12. The tool according to claim 1, wherein the insert defines a distal extension configured to abut a slide of the handgun before the at least one notch engages the magazine release mechanism.

13. The tool according to claim 1 further comprising a thermal barrier disposed between the insert and the housing.

14. The tool according to claim 1, wherein the at least one contoured peripheral surface defines an embossing feature.

15. A method of flaring the handgun magazine well of claim 1 comprising:

heating a proximal end portion of the magazine well until a material of the magazine well reaches its glass transition temperature;

placing the tool of claim 1 into the magazine well;

moving the insert and housing into the magazine well until the at least one contiguously arranged contoured peripheral surface abuts and plastically deforms a mating inner surface of the magazine well;

holding the tool in place for a predetermined period of time; and removing the tool from the magazine well.

16. The method according to claim 15, wherein the step of moving the insert and the housing is manual.

17. The method according to claim 15, wherein the proximal end portion of the magazine well is heated by external source.

18. The method according to claim 17, wherein the external source is oil.

19. A tool for use in flaring a handgun magazine well comprising:

a housing defining at least one contoured peripheral surface;

an insert slidably engaged within the housing; and an adjustment device operatively engaged with the insert and the housing, wherein the contoured peripheral surface is configured to shape a corresponding inner surface of the magazine well.

20. The tool according to claim 19, wherein the insert defines an external geometry corresponding to an external geometry of a magazine configured to slide and lock within the magazine well.

21. The tool according to claim 19, wherein the housing defines a series of contiguously arranged contoured peripheral surfaces.

22. A method of flaring the handgun magazine well of claim 19 comprising:

heating a proximal end portion of the magazine well until a material of the magazine well reaches its glass transition temperature;

placing the tool of claim 19 into the magazine well;

tightening the adjustment nut until the contiguously arranged contoured peripheral surfaces abut and plastically deform mating inner surfaces of the magazine well;

holding the tool in place for a predetermined period of time; and loosening the adjustment nut to remove the tool from the magazine well.

23. A tool for use in flaring a handgun magazine well comprising:

a housing defining a series of contiguously arranged contoured peripheral surfaces and a base portion;

an insert slidably engaged within the housing; and an adjustment device operatively engaged with the insert and the housing, the adjustment device comprising:

a threaded shaft secured to the insert and extending through a bottom portion of the housing; and an adjustment nut threadably engaged with the threaded shaft, wherein the adjustment nut engages the base portion to move the housing towards the magazine well, and the contoured peripheral surfaces are configured to shape corresponding inner surfaces of the magazine well.

* * * * *